United States Patent [19]

Ryan

[11] 4,407,051

[45] Oct. 4, 1983

[54] SLIP-IN DRAPERY HOOK

[75] Inventor: Richard B. Ryan, Libertyville, Ill.

[73] Assignee: Richard Ryan & Associates, Inc., Northbrook, Ill.

[21] Appl. No.: 389,666

[22] Filed: Jun. 18, 1982

Related U.S. Application Data

[63] Continuation-in-part of Ser. No. 172,835, Jul. 28, 1980, Pat. No. 4,344,210, which is a continuation-in-part of Ser. No. 73,668, Sep. 10, 1979, Pat. No. 4,261,080.

[51] Int. Cl.[3] ..... A44B 13/00

[52] U.S. Cl. ..... 24/369; 24/345; 160/348

[58] Field of Search ..... 24/345, 346, 369, 376, 24/365, 375; 160/348

[56] References Cited

U.S. PATENT DOCUMENTS

| | | | |
|---|---|---|---|
| 773,264 | 10/1904 | Gunn | 24/345 |
| 1,053,183 | 2/1913 | Keller | 24/346 |
| 1,219,902 | 3/1917 | Anderson | 24/347 |
| 2,796,928 | 6/1957 | Bernhard et al. | 160/348 |
| 2,901,795 | 9/1959 | Graber | 24/345 |
| 3,114,186 | 12/1963 | Olsen | 24/345 |
| 3,119,444 | 1/1964 | Pokhosnik | 160/348 |
| 3,321,814 | 5/1967 | Graber | 24/345 |
| 3,806,995 | 4/1974 | Gass | 24/346 |
| 4,170,053 | 10/1979 | Rosenziveg | 160/348 |
| 4,261,080 | 4/1981 | Ryan | 24/369 |
| 4,344,210 | 8/1982 | Ryan | 24/369 |

*Primary Examiner*—Paul J. Hirsch

*Attorney, Agent, or Firm*—Merriam, Marshall & Bicknell

[57] ABSTRACT

An adjustable drapery support assembly comprises a vertical elongated base which can be attached at its lower end to the rear surface of a drapery at a point opposite a preformed pleat therein, with the upper end of the base adjacent the upper edge of the drapery. The base is provided at its upper end with a hinged clamping arm which engages the upper edge of the drapery, thereby inhibiting outward sagging of the top thereof. In a preferred embodiment, the clamping arm is provided with a plate member of limited vertical dimension adapted to enter the open end of the pleat, thereby maintaining the angular orientation thereof. The support assembly includes an adjustable hook assembly which can be attached at any desired point along the length of the base.

8 Claims, 8 Drawing Figures

SLIP-IN DRAPERY HOOK

This application is a continuation-in-part of my copending application Ser. No. 172,835, filed July 28, 1980, now U.S. Pat. No. 4,344,210, which is in turn a continuation-in-part of application Ser. No. 73,668, filed Sept. 10, 1979, now U.S. Pat. No. 4,261,080.

This invention relates to a novel adjustable drapery support assembly which is economical to manufacture and readily installed in a drapery, which permits adjustment of the hanging length of the drapery while minimizing unsightly outward sagging of the top of drapery, and which also fixes the angle of projection of the pleats relative to the face of the drapery.

INTRODUCTION

One of the problems involved in the manufacture and installation of a drapery is making adequate provision for adjusting the free length thereof at various points along its width so that the bottom edge of the drapery is uniformly spaced above the floor or other surface in proximity thereto. This problem arises not only at the initial installation of the drapery, but also at later times, e.g., after a cleaning procedure which may affect the length of the drapery, or after an extended period of use, during which the drapery material may have stretched or shrunk. Although the initial installation of custom-made draperies is usually made by experienced professional personnel who are competent to insure that the drapery is hung in a uniform manner, this is not true with respect to mass-produced draperies which must be hung by the purchaser. Further, in both instances, the draperies may be rehung, typically after cleaning, by the owner thereof, who is not normally adept in adjusting the free length of the drapery to insure that it hangs evenly.

A number of adjustable support assemblies for draperies have been suggested in the past, typically incorporating hooks or similar means at the top of the drapery, the position of which can be adjusted vertically over a sufficient distance to provide the necessary adjustment in length. In some of these assemblies, e.g., that shown in U.S. Pat. No. 2,931,612, there is employed a base plate member of a size and configuration which requires that it be sewn by hand into the drapery after pleats are formed therein. Such installation represents an additional operation which increases the cost of the drapery. Other forms of adjusable drapery hooks, e.g., those shown in U.S. Pat. Nos. 3,321,814, 2,448,637, and 2,901,795, are typically made of metal and are relatively complicated in form, both of which factors tend to increase the cost thereof.

Another form of adjustable support assembly is shown in German Patent Application (Offenlegungsschrift) 2,526,820, published Mar. 4, 1976, wherein the support assembly is provided with a thin vane of a flexible material, typically a synthetic resin, which is adapted to be sewn into the rear fold of a pleat of the drapery, the vane being provided with means for attaching a hook at any desired point along the length thereof, thereby affording a means for effectively adjusting the length of the drapery. Because this assembly must be inserted during the sewing of the drapery by skilled and therefore expensive labor, the cost of installation may be unacceptably high for use of the assembly in inexpensive mass-produced draperies.

My copending application Ser. No. 172,835, filed July 28, 1980, now U.S. Pat. No. 4,344,210, discloses an adjustable drapery support including a first elongated member adapted to be inserted into the top of a pleat in a drapery and a second plate member hinged to the top of the first member with interlocking means at the bottom of both members adapted to secure the assembly to the drapery. While the support member disclosed in this patent permits ready adjustment of the height of the drapery and also counteracts the tendency of the unsupported top thereof to sag, it cannot be used in certain common forms of drapery constructions in which the pleats are interconnected by a horizontal line of stitching which provides insufficient depth for insertion of the first elongated member.

SUMMARY OF THE INVENTION

In accordance with the present invention, there is provided an adjustable drapery support assembly which can be easily and inexpensively installed in a drapery provided with pleats having folds which are obstructed by a horizontal line of stitching at a point relatively close to the top. In a preferred embodiment, the assembly includes provision for counteracting the tendency of the top of the drapery to sag outwardly when the point of support is lowered. Briefly described, the support assembly of the invention comprises a vertical elongated base provided with means at its lower end for attaching the base to the rear surface of a drapery at a point opposite a preformed pleat therein, with the upper end of the base adjacent the upper edge of the drapery. The base is provided at its upper end with a hinged clamping arm which engages the upper edge of the drapery, thereby inhibiting outward sagging of the top thereof. In a preferred embodiment, the clamping arm is provided with a plate member of limited vertical dimension adapted to enter the open end of the pleat, thereby maintaining the angular orientation thereof. The support includes an adjustable attaching means including a hook assembly which can be attached at any desired point along the length of the base. The base preferably has a contour which tapers upwardly and inwardly toward the drapery, thereby further tending to counteract the tendency of the upper edge of the drapery to sag outwardly, as the point of support is lowered.

DESCRIPTION OF THE DRAWINGS

The invention will be better understood from the detailed description which follows, taken in conjunction with the accompanying drawings, in which.

DETAILED DESCRIPTION OF THE PREFERRED EMBODIMENT

Figure 8:
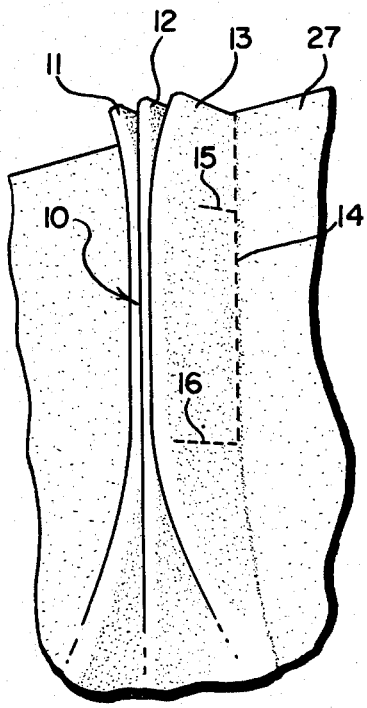
FIG. 8 is an isometric view of the drapery shown in FIG. 1.

The drapery support of the invention is intended to be installed, in customary fashion, on the rear surface of a drapery at spaced points along the top edge thereof opposite pleats formed in the drapery by conventional means. In one common method of forming pleats, there is employed a drapery heading, i.e., a narrow strip of material which is attached on the rear surface of the drapery material adjacent its upper edge before pleats are formed therein. A pleat 10 (FIG. 8) is conventionally formed in such a drapery by gathering the drapery material, together with the drapery heading, to form the desired number of folds, e.g., 11, 12, 13, and fixing the pleat, by means of a vertical seam 14 and one or two spaced horizontal seams 15 and 16. The form of pleat shown in FIG. 8 is known as an "F-tack" because of the resemblance of the seams to an inverted letter "F". If seam 15 is omitted, the construction is known as an "L-tack".

Figure 1:
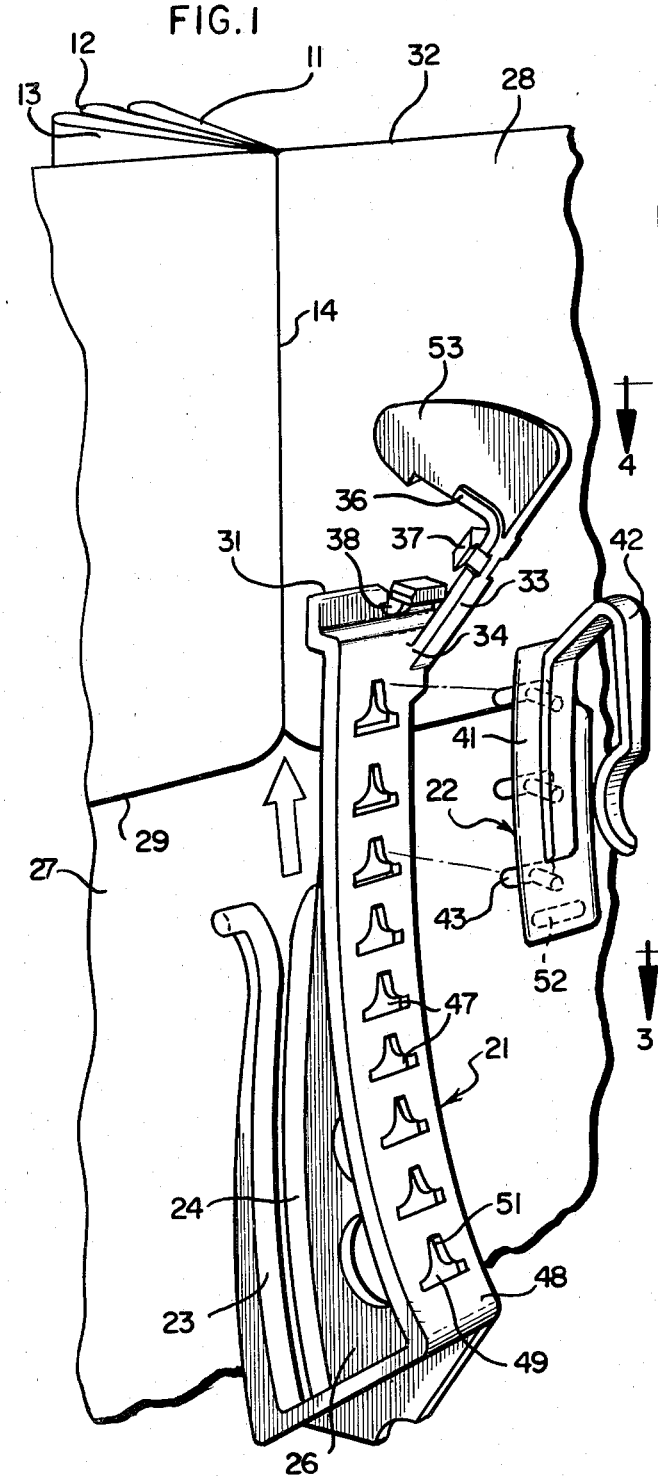
FIG. 1 is an isometric exploded view of the drapery support of the invention in position to be attached to the rear upper edge of a drapery.
Figure 2:
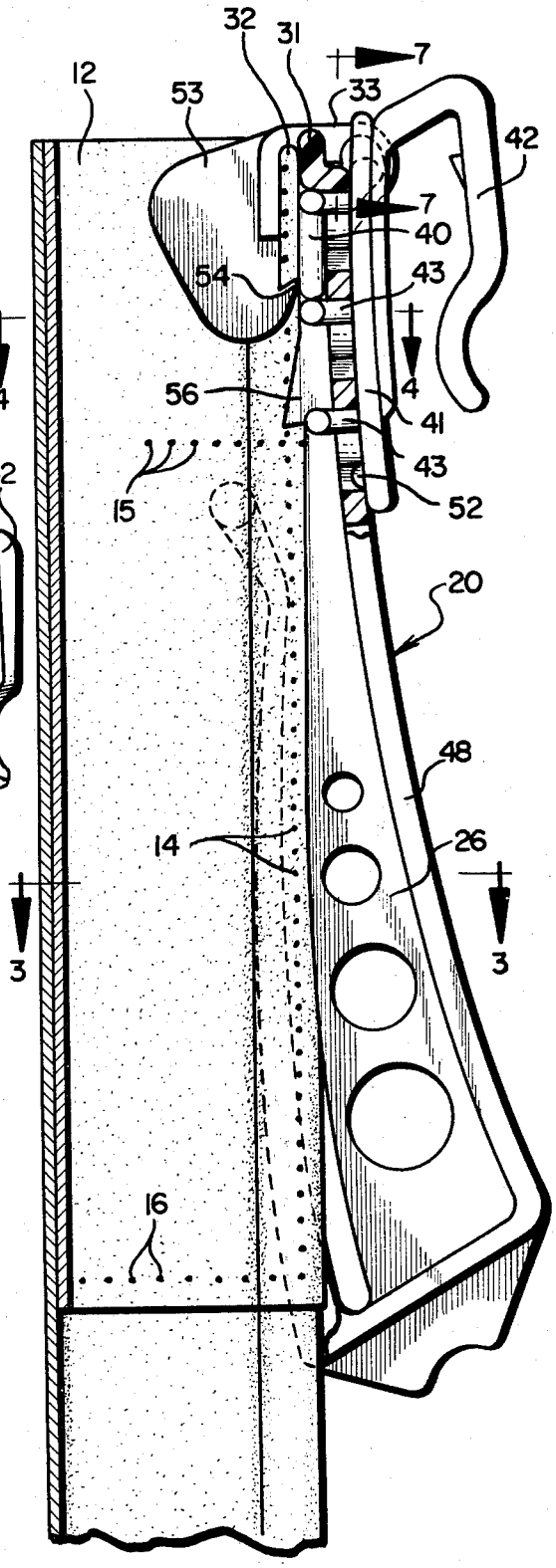
FIG. 2 is a left side view of the drapery support of FIG. 1 after installation in the drapery with a portion of the drapery cut away and the near prong of the hook assembly broken away.
Figure 3:
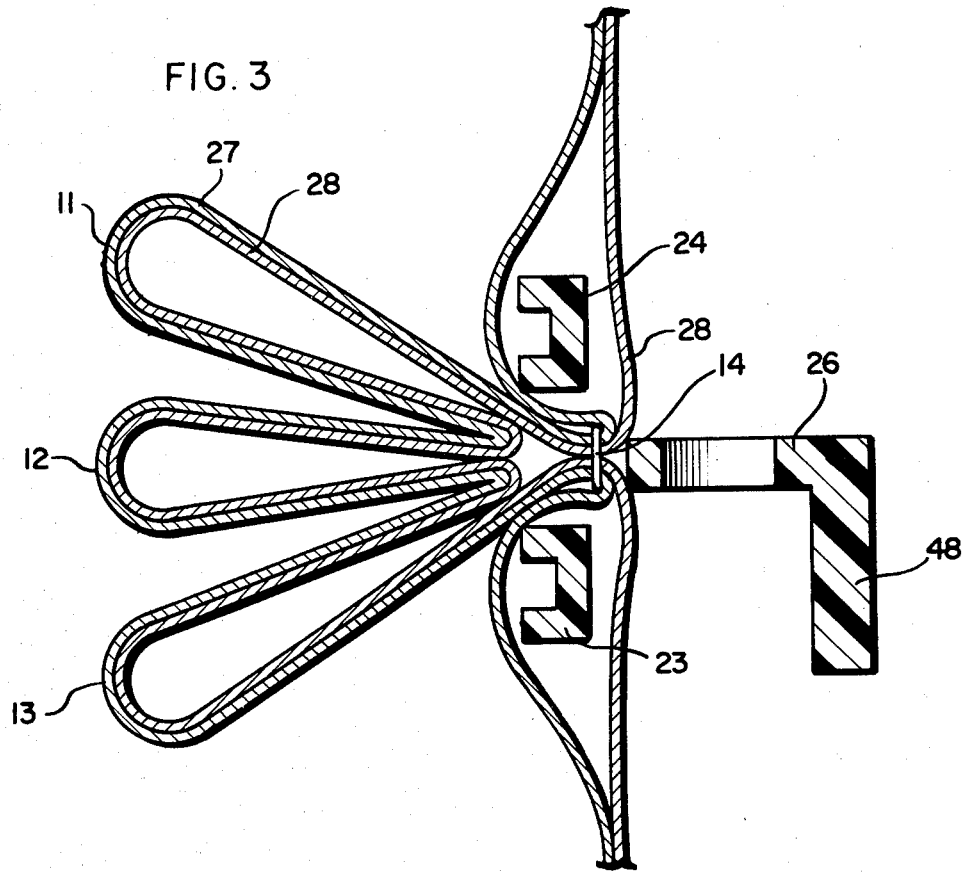
FIG. 3 is a cross-sectional view along the line 3—3 of FIG. 2.

The embodiment of the invention shown in the drawings is particularly designed for use with draperies made with a drapery heading and an F-tack or L-tack type of pleat construction, although the invention is not restricted to such use. As shown in FIGS. 1 and 2, the drapery support assembly 20 comprises two sub-assemblies, a base assembly 21 and a hook assembly 22, provided with interlocking elements permitting the positioning of the hook assembly 22 at a desired point along one edge of base assembly 21. Base assembly 21 is provided with a pair of generally parallel upwardly extending prongs 23 and 24 attached at their bottom ends to the lower end of a vertical elongated base 26. Each of prongs 23 and 24 is adapted to enter an upwardly extending pocket, open at its bottom, formed between drapery material 27 and drapery heading 28, the lower edge 29 of which is not secured to the drapery, with seam 14 positioned in the space between adjacent prongs 23 and 24.

The width of drapery heading 28 is chosen to be approximately equal to the length of base 26 so that when prongs 23 and 24 are inserted as previously described and the lower edge 29 of drapery heading 28 is supported by the junction between the lower ends of prongs 23, 24 and base 26, the upper end 31 of base 26 is approximately level with the upper edge 32 of the drapery.

At the upper end of base 26 is affixed a generally arcuate downwardly concave arm 33 having one of its ends 34 hinged to base 26. Any suitable means for providing the hinged connection between arm 33 and base 26 can be used. In the embodiment shown, which is suitably formed of a molded semi-rigid material such as a synthetic plastic, the resilient material of arm 33 serves as a hinge. Alternatively, any conventional type of hinge construction can be used.

Figure 5:
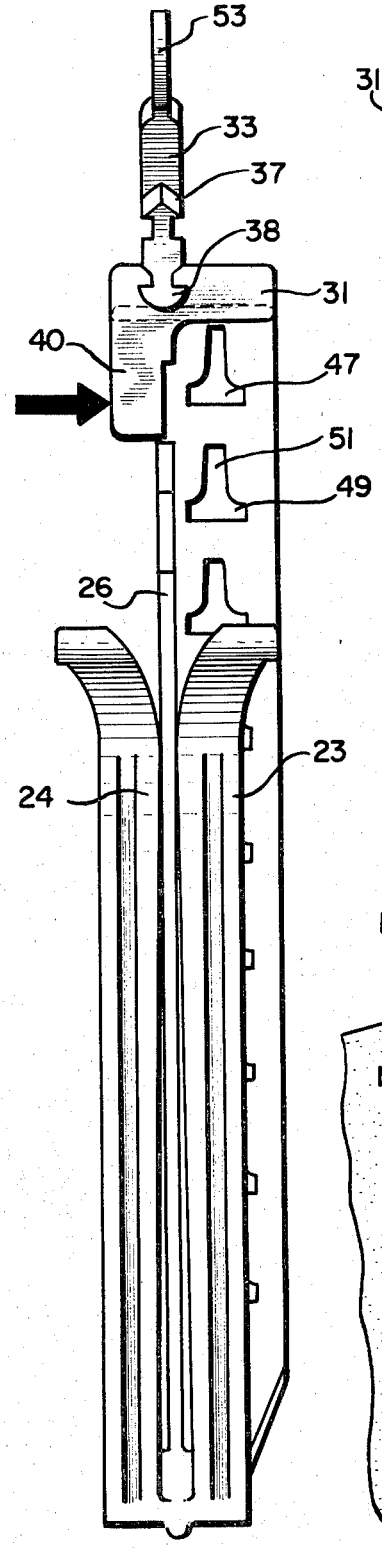
FIG. 5 is a rear view of the assembly shown in FIG. 1.
Figure 7:
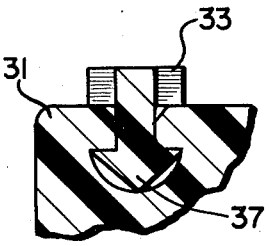
FIG. 7 is a sectional view along the line 7—7 of FIG. 2.
Figure 6:
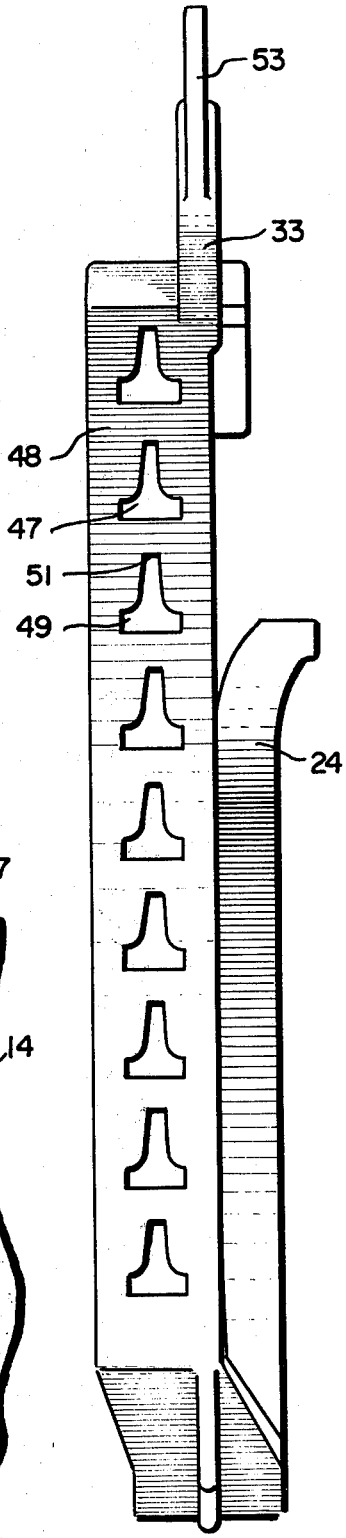
FIG. 6 is a front view of the assembly of FIG. 1.

Because of its hinged end, arm 33 can be swung over upper edge 32 of the drapery and into the open end of a fold, e.g., 12, in the adjacent pleat. Arm 33 has a size and contour such that when it is inserted into fold 12 in this manner, the free end 36 of arm 33 clamps upper edge 32 of the drapery firmly against the upper end 31 of base 26, as shown in FIG. 2. In order to maintain arm 33 in its clamped position, base 26 and arm 33 are provided with suitable interlocking releasable clamping means, which in the embodiment shown consists of a barbed lug 37 on the concave lower edge of arm 33 which interlocks with a suitably positioned and shaped latching recess 38 in base 26. Because of the resilient nature of the material of which both lug 37 and base 26 are formed, arm 33 can be locked in its clamping position by applying appropriate manual pressure to the upper edge of the arm. In order to facilitate disengagement of lug 37 from recess 38 when desired, end 31 of base 26 is provided with a depending arm 40 located below recess 38 (FIG. 5). Pressure on arm 40 in the direction of the arrow in FIG. 5 will cause recess 38 to enlarge sufficiently to permit lug 37 to be withdrawn from recess 38.

Figure 4:
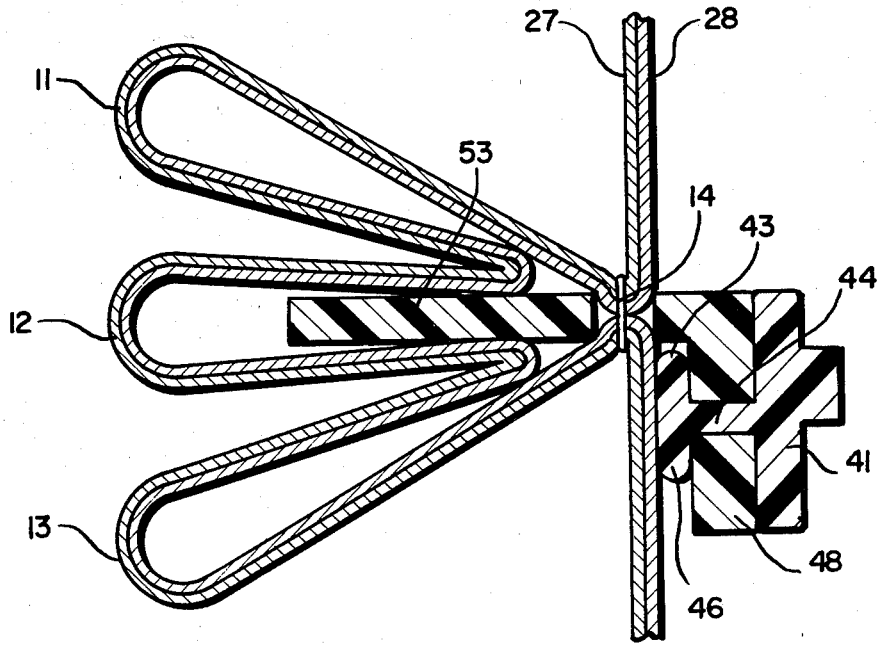
FIG. 4 is a cross-sectional view along the line 4—4 of FIG. 2.

In order to permit hanging of the drapery on a traverse rod or the like, the support of the invention is provided with a movable hook assembly 22 comprising a base plate 41 and a downwardly opening hook 42 affixed to the outer surface of the base plate. Extending outwardly from the opposite inner surface of base plate 41 are at least one and preferably two or more uniformly spaced barbs 43, each of which comprises a shaft 44 to the end of which is fixed a transverse crosspiece 46 (FIG. 4). Barbs 43 interlock with spaced apertures 47 formed in flange 48 affixed to the edge of base 26. Each of apertures 47 has the form of an inverted "T", including a horizontal base portion 49 and a vertical stem portion 51. The spacing between adjacent apertures 47 corresponds to the spacing between barbs 43 in hook assembly 22, thus permitting the hook assembly to be attached at any desired point along the length of flange 48.

Hook assembly 22 is attached to base assembly 21 by passing barbs 43 through apertures 47 at a selected location along the length of flange 48 and, by an upward sliding motion of the hook assembly, causing shafts 44 to enter stem portions 51 of the apertures. To prevent accidental disengagement of the hook assembly, as might occur during handling of the drapery preparatory to hanging, base plate 41 is provided with an inwardly extending rounded lug 52 sized and positioned to enter the base portion of an open aperture below the lowermost barb, when the barbs are in locked position within the apertures. If it is desired to reposition a hook assembly, base plate 41 can be deflected sufficiently to withdraw lug 52 from its locking position, permitting the hook assembly to be removed by a downward sliding movement.

The edge of base 26 along which flange 48 is attached tapers inwardly toward the opposite generally vertical edge adjacent the drapery, thereby counteracting the tendency of the top of the drapery to sag as the point of attachment of the hook assembly to the base is lowered, as disclosed in my U.S. Pat. No. 4,261,080. While flange 48 can be straight, it is desirably outwardly concave as shown.

Although the tapering contour of base 26 and arm 33 gripping the drapery reduce the tendency of upper edge 32 thereof to sag, they do not affect the angular orientation of pleat 10 with respect to the face of the drapery. For a neat and uniform appearance, it is desirable that the pleats extend outwardly at substantially right angles to the face of the drapery, rather than being inclined to one side or the other. In order to maintain the pleats in the desired perpendicular orientation, there is affixed to the free end 36 of arcuate arm 33 a vertical pleat alignment plate 53 having dimensions adapted to permit it to enter an open end of one of the folds, e.g., 12, of pleat 10. To provide additional support for the drapery against vertical sagging, the inner edge of plate 53 may be provided with an inwardly directed barb 54 which grips the material of the drapery when the assembly is locked. A similar barb 56 may be provided on the inner edge of base 26 to serve the same function.

As shown, most of the surface of plate 53 is hidden within fold 12 when arm 33 is in its latched position shown in FIG. 2. Accordingly, alignment plate 53 is substantially invisible when the drapery is hung. It will also be seen that the vertical penetration of plate 53 into fold 12 in the latched position is less than the spacing of the upper horizontal stitching 15 of the F-tack construction below the upper edge of the drapery, so that no interference with the stitching is encountered.

Although the invention has been described with particular reference to its use with a drapery formed with a drapery heading, it is not restricted thereto. If a drapery heading is not used, the drapery support can be provided with an appropriate prong adapted to penetrate and support the material of the drapery, rather than the two-armed prong described herein, as will be apparent to those skilled in the art.

The foregoing detailed description has been given for clearness of understanding only, and no unnecessary limitations should be understood therefrom as modifications will be obvious to those skilled in the art.

What is claimed is:

1. A drapery support for a drapery having a preformed pleat comprising:

a vertical elongated base, having an upper and a lower end;

attaching means adjacent the lower end of said base for attaching said base to the rear surface of said drapery at a location opposite said pleat, with the upper end of said base adjacent the upper edge of said drapery;

clamp means associated with the upper end of said base for engaging the upper edge of said drapery; and a hook assembly for engaging a traverse rod or the like, said assembly being adapted to be removably secured to said base at a selected location along its length.

2. A drapery support in accordance with claim 1 wherein said attaching means comprises an upwardly extending prong means adapted to engage and support said drapery.

3. A drapery support in accordance with claim 2 wherein said prong means has two generally parallel arms, each of which is adapted to enter a vertically extending pocket on the rear surface of said drapery.

4. A drapery support in accordance with claim 2, wherein said clamp means comprises an arcuate downwardly concave arm having one end hinged to said base adjacent its upper end, the other end of said arm being movable over the upper edge of said drapery to a clamping position wherein said arm clamps said drapery to said base, and releasable latch means associated with said upper end of said base for maintaining said arm in said clamping position.

5. A drapery support in accordance with claim 4, further including a vertical pleat alignment plate attached to said other end of said clamping arm, said plate being adapted to enter the upper end of an open fold of said pleat when said arm is in its clamping position.

6. A drapery support in accordance with claim 5 wherein said base has a first generally vertical edge adjacent said prong means and a second edge opposite thereto, said second edge tapering towards said first edge in a direction toward the upper end of said base, said hook assembly being attachable to said base along said second edge.

7. A drapery support in accordance with claim 6 wherein said second edge is outwardly concave.

8. A drapery support in accordance with claim 2, wherein said prong means has an upper end which is substantially below the upper end of said base.

* * * * *